US012111101B2

(12) United States Patent
Chan et al.

(10) Patent No.: US 12,111,101 B2
(45) Date of Patent: Oct. 8, 2024

(54) TWO-STAGE HEAVIES REMOVAL IN LNG PROCESSING

(71) Applicant: ConocoPhillips Company, Houston, TX (US)

(72) Inventors: Jinghua Chan, Houston, TX (US); Paul R. Davies, Houston, TX (US); Qi Ma, Houston, TX (US); Michael J. Calderon, Houston, TX (US); Dale L. Embry, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 16/893,992

(22) Filed: Jun. 5, 2020

(65) Prior Publication Data

US 2020/0386474 A1 Dec. 10, 2020

Related U.S. Application Data

(60) Provisional application No. 62/857,683, filed on Jun. 5, 2019.

(51) Int. Cl.
*F25J 1/00* (2006.01)
*F25J 3/02* (2006.01)
(Continued)

(52) U.S. Cl.
CPC ..... *F25J 1/0022* (2013.01); *F25J 3/0233* (2013.01); *F25J 3/0238* (2013.01); *F25J 3/0242* (2013.01);
(Continued)

(58) Field of Classification Search
CPC ..... F25J 1/0022; F25J 3/0209; F25J 2210/04; F25J 2220/64; F25J 2245/02; F25J 3/0238; F25J 3/0233; F25J 3/0247; B01D 53/002
See application file for complete search history.

(56) References Cited

U.S. PATENT DOCUMENTS 3,407,613 A * 10/1968 Muller ..... C10G 5/06 48/190
3,707,066 A 12/1972 Carne et al.
(Continued)

FOREIGN PATENT DOCUMENTS

WO WO-2014149465 A1 9/2014
WO WO-2017220591 A1 12/2017
WO WO-2019099608 A1 5/2019

OTHER PUBLICATIONS

Supplementary European Search Report for Application No. EP 20 81 8422 dated May 22, 2023 (8 pages).
(Continued)

*Primary Examiner* — Brian M King
(74) *Attorney, Agent, or Firm* — Polsinelli PC

(57) ABSTRACT

Implementations described and claimed herein provide systems and methods for processing liquefied natural gas (LNG). In one implementation, a feed gas is received and partially condensed into a two-phase stream by expanding the feed gas. A liquid containing fouling components is removed from the two-phase stream. A vapor generated from the two-phase stream is compressed into a compressed feed gas. The compressed feed gas is directed into a feed chiller heat exchanger. The compressed feed gas is free of the fouling components.

14 Claims, 4 Drawing Sheets

(51) Int. Cl.
*F28D 3/02* (2006.01)
*F28D 3/04* (2006.01)
*F28D 21/00* (2006.01)

(52) U.S. Cl.
CPC ..... *F25J 3/0247* (2013.01); *F28D 3/02* (2013.01); *F28D 3/04* (2013.01); *F25J 2205/02* (2013.01); *F25J 2205/04* (2013.01); *F25J 2205/10* (2013.01); *F25J 2215/60* (2013.01); *F25J 2220/64* (2013.01); *F28D 2021/0064* (2013.01)

(56) References Cited

U.S. PATENT DOCUMENTS 4,157,904 A * 6/1979 Campbell ..... F25J 3/0209 62/623
4,445,916 A * 5/1984 Newton ..... F25J 1/0216 62/621
4,813,986 A * 3/1989 Humble ..... F25J 1/0022 165/95
5,442,924 A * 8/1995 Tsai ..... C10L 3/10 62/611
5,600,969 A 2/1997 Low
6,023,942 A * 2/2000 Thomas ..... F17C 1/14 62/619
6,526,777 B1 3/2003 Campbell et al.
2005/0092594 A1* 5/2005 Parro ..... F25J 3/0233 203/100
2006/0277943 A1* 12/2006 Yokohata ..... C07C 7/04 62/620
2008/0271480 A1* 11/2008 Mak ..... F25J 1/0255 62/626
2010/0316806 A1 12/2010 He et al.
2011/0023536 A1* 2/2011 Jager ..... F25J 1/0231 62/611
2013/0036763 A1* 2/2013 Vist ..... F25J 1/0022 62/611
2016/0200937 A1 7/2016 Hu et al.
2017/0176099 A1* 6/2017 Gaskin ..... F25J 3/0238
2018/0066889 A1* 3/2018 Gaskin ..... F25J 3/0209
2018/0273858 A1* 9/2018 Davies ..... B01D 3/143
2019/0086147 A1* 3/2019 Brown, III ..... F25J 1/0231

OTHER PUBLICATIONS

International Search Report and Written Opinion for International Application No. PCT/US2020/036340, dated Sep. 14, 2020, 6 pages.

* cited by examiner

TWO-STAGE HEAVIES REMOVAL IN LNG PROCESSING

CROSS-REFERENCE TO RELATED APPLICATIONS

The present application claims priority to U.S. Provisional Application No. 62/857,683, entitled "Two-Stage Heavies Removal in LNG Processing" and filed on Jun. 5, 2019, which is incorporated by reference herein in its entirety.

BACKGROUND

I. Technical Field

Aspects of the present disclosure relate generally to systems and methods for liquefaction of natural gas and more particularly to elimination of freezing during processing of liquefied natural gas (LNG) through two-stage heavies removal using a heavies pre-removal section and a heavies deep-removal section.

II. State of the Art

Natural gas is a commonly used resource comprised of a mixture of naturally occurring hydrocarbon gases typically found in deep underground natural rock formations or other hydrocarbon reservoirs. More particularly, natural gas is primarily comprised of methane and often includes other components, such as, ethane, propane, carbon dioxide, nitrogen, hydrogen sulfide, and/or the like.

Cryogenic liquefaction generally converts the natural gas into a convenient form for transportation and storage. More particularly, under standard atmospheric conditions, natural gas exists in vapor phase and is subjected to certain thermodynamic processes to produce LNG. Liquefying natural gas greatly reduces its specific volume, such that large quantities of natural gas can be economically transported and stored in liquefied form.

Some of the thermodynamic processes generally utilized to produce LNG involve cooling the natural gas to near atmospheric vapor pressure. For example, a natural gas stream may be sequentially passed at an elevated pressure through multiple cooling stages that cool the gas to successively lower temperatures until the liquefaction temperature is reached. Stated differently, the natural gas stream is cooled through indirect heat exchange with one or more refrigerants, such as propane, propylene, ethane, ethylene, methane, nitrogen, carbon dioxide, and/or the like, and expanded to near atmospheric pressure.

During cooling of the processed natural gas stream, trace amounts of intermediate components, such as propanes, butanes, and pentanes, and heavy hydrocarbon components ("heavies"), such as C12 to C16 hydrocarbons, often freeze in downstream systems of in an LNG plant, including heat exchangers. As these components freeze during the cooling process, deposits buildup on internal surfaces of various systems of the LNG plant. Such fouling may result in a shutdown of one or more systems of the LNG plant to remove the deposits, resulting in a loss of production. For example, conventional LNG plants may experience an increase in pressure drop in a chilling area of the LNG train, such as a heat exchanger. The pressure drop may increase beyond system constraints unless train throughput is curtailed and eventually shutdown to de-rim the heat exchanger to remove deposits. Conventionally, the cycle of pressure drop increase, feed curtailment, shutdown, and de-riming of the heat exchanger continues as a result of fouling.

It is with these observations in mind, among others, that various aspects of the present disclosure were conceived and developed.

SUMMARY

Implementations described and claimed herein address the foregoing problems by providing systems and methods for processing liquefied natural gas (LNG). In one implementation, a feed gas is received and partially condensed into a two-phase stream by expanding the feed gas. A liquid containing fouling components is removed from the two-phase stream. A vapor generated from the two-phase stream is compressed into a compressed feed gas. The compressed feed gas is directed into a feed chiller heat exchanger. The compressed feed gas is free of the fouling components.

In another implementation, a composition of a feed gas is modified with bottoms liquid recirculated from a heavies removal unit. Fouling components are removed from the feed gas in a first stage of heavies removal. The fouling components are removed by separating an isentropically expanded stream into a liquid containing the fouling components and a vapor. The vapor is compressed to form the feed gas free of the fouling components. The feed gas free of the fouling components is directed into a feed chiller heat exchanger.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTION OF THE DRAWINGS

The foregoing summary, as well as the following detailed description, will be better understood when read in conjunction with the appended drawing. For the purpose of illustration, there is shown in the drawing certain embodiments of the present inventive concept. It should be understood, however, that the present inventive concept is not limited to the precise embodiments and features shown. The accompanying drawing, which is incorporated in and constitutes a part of this specification, illustrates an implementation of apparatuses consistent with the present inventive concept and, together with the description, serves to explain advantages and principles consistent with the present inventive concept, in which.

DETAILED DESCRIPTION

Figure 1:
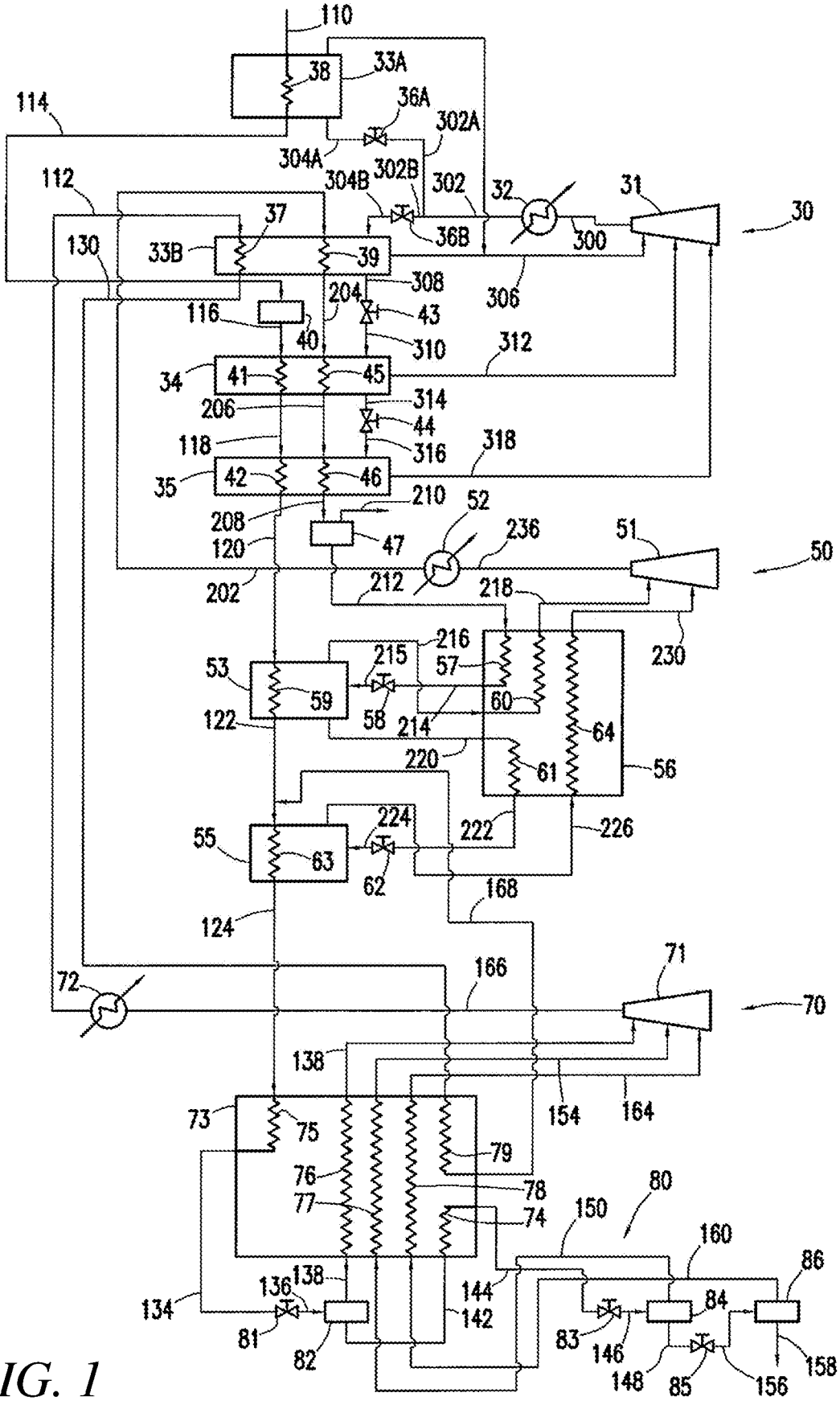
FIG. 1 illustrates an example simplified flow diagram of a cascade refrigeration process with a two-stage heavies removal for LNG production.

Aspects of the present disclosure involve systems and methods for reducing fouling in LNG production. In one aspect, a removal of very heavy hydrocarbon components (C12+) is segregated from a removal of the rest of heavy hydrocarbon components (C6-C11), so solid deposition is eliminated or otherwise reduced in the natural gas initial chilling section of the LNG process. More particularly, LNG plant feedstocks often contain heavy hydrocarbon components which tend to form solids (i.e. "freeze") at the cryogenic temperatures required for a natural gas liquefaction process. If not sufficiently removed prior to the feed gas entering at the cold sections of an LNG production plant, freeze and solid deposition of these heavy hydrocarbon components (typically C6+) could result the loss of the process equipment and thus LNG production. As such, the presently disclosed technology integrates a Two-stage Heavies Removal Unit (THRU) in LNG liquefaction process, including a Heavies Pre-Removal (HPR) section and Heavies Deep-Removal (HDR) section to remove heavy components in so-called "contaminated lean" natural gases, which have a very low quantity of C2-C9 but carry some tail-end heavy components such as C12+. Freezing of these very heavy hydrocarbon components occur in the early chilling sections of the LNG production process for such natural gases. Thus, in one aspect, the C12+ are removed in a Heavies Pre-Removal (HPR) section in a first stage of heavies removal to prevent freezing and equipment detriment in the chilling sections, and =C6-C11 in the chilled gas are removed in a second heavies removal stage to prevent freezing in the downstream liquefaction equipment. As such, aspects of the presently disclosed technology involve a THRU with an internal liquid recycling within the LNG liquefaction process.

The presently disclosed technology thus: reliably eliminates freezing in chilling and liquefaction areas of the LNG train, thereby improving LNG production, and provides a customizable system that may deployable into various LNG train architectures, among other advantages that will be apparent from the present disclosure.

I. Terminology

The liquefaction process described herein may incorporate one or more of several types of cooling systems and methods including, but not limited to, indirect heat exchange, vaporization, and/or expansion or pressure reduction.

Indirect heat exchange, as used herein, refers to a process involving a cooler stream cooling a substance without actual physical contact between the cooler stream and the substance to be cooled. Specific examples of indirect heat exchange include, but are not limited to, heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some implementations, expansion means may be a Joule-Thomson expansion valve. In other implementations, the expansion means may be either a hydraulic or gas expander. Because expanders recover work energy from the expansion process, lower process stream temperatures are possible upon expansion.

In the description, phraseology and terminology are employed for the purpose of description and should not be regarded as limiting. For example, the use of a singular term, such as "a", is not intended as limiting of the number of items. Also, the use of relational terms such as, but not limited to, "down" and "up" or "downstream" and "upstream", are used in the description for clarity in specific reference to the figure and are not intended to limit the scope of the present inventive concept or the appended claims. Further, any one of the features of the present inventive concept may be used separately or in combination with any other feature. For example, references to the term "implementation" means that the feature or features being referred to are included in at least one aspect of the present inventive concept. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the present inventive concept may include a variety of combinations and/or integrations of the implementations described herein. Additionally, all aspects of the present inventive concept as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

Some LNG projects introduce pipelines as a source of feed gas in an LNG Optimized Cascade Process (OCP). The Optimized Cascade Process is based on three multi-staged, cascading refrigerants circuits using pure refrigerants, brazed aluminum heat exchangers and insulated cold box modules. Pure refrigerants of propane (or propylene), ethylene, and methane may be utilized.

The Optimized Cascade Process may use a two-stage heavies removal unit (heavies removal unit or HRU) to eliminate C6+hydrocarbons (i.e. heavy components) from the natural gas prior to condensing the gas to LNG. In the usual case, the gas has already been amine treated and dehydrated prior to heavies removal. Heavies removal is done to prevent freezing from occurring in the liquefaction heat exchangers and to moderate the heating value of the LNG. It also prevents LNG from being outside specification limits due to increased levels of heavy components.

The presently disclosed technology may be implemented in a cascade LNG system employing a cascade-type refrigeration process using one or more predominately pure component refrigerants. The refrigerants utilized in cascade-type refrigeration processes can have successively lower boiling points to facilitate heat removal from the natural gas stream that is being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

In one implementation, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may include a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising three different refrigerants in three separate refrigeration cycles is made, this is not intended to be limiting. It is recognized that a cascade LNG process involving any number of refrigerants and/or refrigeration cycles may be compatible with one or more implementations of the presently disclosed technology. Other variations to the cascade LNG process are also contemplated. It will also be appreciated that the presently disclosed technology may be utilized in non-cascade LNG processes. One example of a non-cascade LNG process involves a mixed refrigerant LNG process that employs a combination of two or more refrigerants to cool the natural gas stream in at least one cooling cycle.

Figure 2:
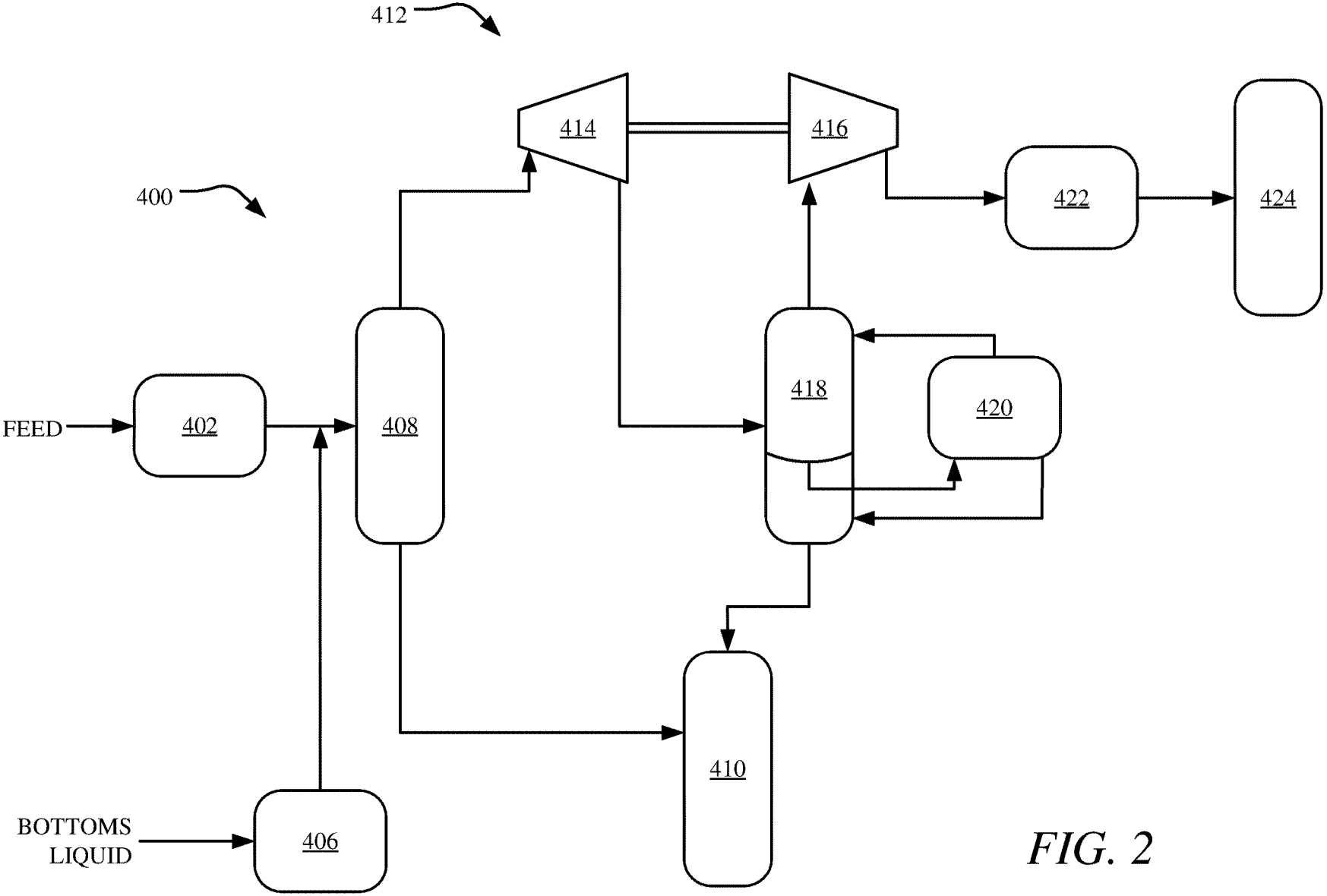
FIG. 2 shows an example LNG production system with a two-stage heavies removal.

To begin a detailed description of an example cascade LNG facility 100 in accordance with the implementations described herein, reference is made to FIG. 1. The LNG facility 100 generally comprises a first refrigeration cycle 30 (e.g., a propane refrigeration cycle), aa second refrigeration cycle 50 (e.g., an ethylene refrigeration cycle), and a third refrigeration cycle 70 (e.g., a methane refrigeration cycle) with an expansion section 80. FIG. 2 illustrates shows an example LNG production system 400 with two-stage heavies removal that may be integrated with an LNG producing facility, such as the LNG facility 100. Those skilled in the art will recognize that FIGS. 1-2 are schematics only and, therefore, various equipment, apparatuses, or systems that would be needed in a commercial plant for successful operation have been omitted for clarity. Such components might include, for example, compressor controls, flow and level measurements and corresponding controllers, temperature and pressure controls, pumps, motors, filters, additional heat exchangers, valves, and/or the like. Those skilled in the art will recognize such components and how they are integrated into the systems and methods disclosed herein.

In one implementation, the main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expansion valve and/or expander 81, a high-stage methane flash drum 82, an intermediate-stage methane expansion valve and/or expander 83, an intermediate-stage methane flash drum 84, a low-stage methane expansion valve and/or expander 85, and a low-stage methane flash drum 86. While "propane," "ethylene," and "methane" are used to refer to respective first, second, and third refrigerants, it should be understood that these are examples only, and the presently disclosed technology may involve any combination of suitable refrigerants.

Referring to FIG. 1, in one implementation, operation of the LNG facility 100 begins with the propane refrigeration cycle 30. Propane is compressed in a multi-stage (e.g., three-stage) propane compressor 31 driven by, for example, a gas turbine driver (not illustrated). The stages of compression may exist in a single unit or a plurality of separate units mechanically coupled to a single driver. Upon compression, the propane is passed through a conduit 300 to a propane cooler 32 where the propane is cooled and liquefied through indirect heat exchange with an external fluid (e.g., air or water). A portion of the stream from the propane cooler 32 can then be passed through conduits 302 and 302A to a pressure reduction system 36A, for example, an expansion valve, as illustrated in FIG. 1. At the pressure reduction system 36A, the pressure of the liquefied propane is reduced, thereby evaporating or flashing a portion of the liquefied propane. A resulting two-phase stream then flows through a conduit 304A into a high-stage propane chiller 33A, which cools the natural gas stream in indirect heat exchange 38. A high stage propane chiller 33A uses the flashed propane refrigerant to cool the incoming natural gas stream in a conduit 110. Another portion of the stream from the propane cooler 32 is routed through a conduit 302B to another pressure reduction system 36B, illustrated, for example, in FIG. 1 as an expansion valve. At the pressure reduction system 36B, the pressure of the liquefied propane is reduced in a stream 304B.

The cooled natural gas stream from the high-stage propane chiller 33A flows through a conduit 114 to a separation vessel. At the separation vessel, water and in some cases a portion of the propane and/or heavier components are removed. In some cases where removal is not completed in upstream processing, a treatment system 40 may follow the separation vessel. The treatment system 40 removes moisture, mercury and mercury compounds, particulates, and other contaminants to create a treated stream. The stream exits the treatment system 40 through a conduit 116. The stream 116 then enters the intermediate-stage propane chiller 34. At the intermediate-stage propane chiller 34, the stream is cooled in indirect heat exchange 41 via indirect heat exchange with a propane refrigerant stream. The resulting cooled stream output into a conduit 118 is routed to the low-stage propane chiller 35, where the stream can be further cooled through indirect heat exchange means 42. The resultant cooled stream exits the low-stage propane chiller 35 through a conduit 120. Subsequently, the cooled stream in the conduit 120 is routed to the high-stage ethylene chiller 53.

A vaporized propane refrigerant stream exiting the high-stage propane chillers 33A and 33B is returned to a high-stage inlet port of the propane compressor 31 through a conduit 306. An unvaporized propane refrigerant stream exits the high-stage propane chiller 33B via a conduit 308 and is flashed via a pressure reduction system 43, illustrated in FIG. 1 as an expansion valve, for example. The liquid propane refrigerant in the high-stage propane chiller 33A provides refrigeration duty for the natural gas stream. A two-phase refrigerant stream enters the intermediate-stage propane chiller 34 through a conduit 310, thereby providing coolant for the natural gas stream (in conduit 116) and the stream entering the intermediate-stage propane chiller 34 through a conduit 204. The vaporized portion of the propane refrigerant exits the intermediate-stage propane chiller 34 through a conduit 312 and enters an intermediate-stage inlet port of the propane compressor 31. The liquefied portion of the propane refrigerant exits the intermediate-stage propane chiller 34 through a conduit 314 and is passed through a pressure-reduction system 44, for example an expansion valve, whereupon the pressure of the liquefied propane refrigerant is reduced to flash or vaporize a portion of the liquefied propane. The resulting vapor-liquid refrigerant stream is routed to the low-stage propane chiller 35 through a conduit 316. At the low-stage propane chiller 35, the refrigerant stream cools the methane-rich stream and an ethylene refrigerant stream entering the low-stage propane chiller 35 through the conduits 118 and 206, respectively. The vaporized propane refrigerant stream exits the low-stage propane chiller 35 and is routed to a low-stage inlet port of the propane compressor 31 through a conduit 318. The vaporized propane refrigerant stream is compressed and recycled at the propane compressor 31 as previously described.

In one implementation, a stream of ethylene refrigerant in a conduit 202 enters the high-stage propane chiller 33B. At the high-stage propane chiller 33B, the ethylene stream is cooled through indirect heat exchange 39. The resulting cooled ethylene stream is routed in the conduit 204 from the high-stage propane chiller 33B to the intermediate-stage propane chiller 34. Upon entering the intermediate-stage propane chiller 34, the ethylene refrigerant stream may be further cooled through indirect heat exchange 45 in the intermediate-stage propane chiller 34. The resulting cooled ethylene stream exits the intermediate-stage propane chiller 34 and is routed through a conduit 206 to enter the low-stage propane chiller 35. In the low-stage propane chiller 35, the ethylene refrigerant stream is at least partially condensed, or condensed in its entirety, through indirect heat exchange 46. The resulting stream exits the low-stage propane chiller 35 through a conduit 208 and may be routed to a separation vessel 47. At the separation vessel 47, a vapor portion of the stream, if present, is removed through a conduit 210, while a liquid portion of the ethylene refrigerant stream exits the separator 47 through a conduit 212. The liquid portion of the ethylene refrigerant stream exiting the separator 47 may have a representative temperature and pressure of about −24° F. (≈−31° C.) and about 285 psig (≈1,965 kPa and 20 bar). However, other temperatures and pressures are contemplated.

Turning now to the ethylene refrigeration cycle 50 in the LNG facility 100, in one implementation, the liquefied ethylene refrigerant stream in the conduit 212 enters an ethylene economizer 56, and the stream is further cooled by an indirect heat exchange 57 at the ethylene economizer 56. The resulting cooled liquid ethylene stream is output into a conduit 214 and routed through a pressure reduction system 58, such as an expansion valve. The pressure reduction system 58 reduces the pressure of the cooled predominantly liquid ethylene stream to flash or vaporize a portion of the stream. The cooled, two-phase stream in a conduit 215 enters the high-stage ethylene chiller 53. In the high-stage ethylene chiller 53, at least a portion of the ethylene refrigerant stream vaporizes to further cool the stream in the conduit 120 entering an indirect heat exchange 59. The vaporized and remaining liquefied ethylene refrigerant exits the high-stage ethylene chiller 53 through conduits 216 and 220, respectively. The vaporized ethylene refrigerant in the conduit 216 may re-enter the ethylene economizer 56, and the ethylene economizer 56 warms the stream through an indirect heat exchange 60 prior to entering a high-stage inlet port of the ethylene compressor 51 through a conduit 218. Ethylene is compressed in multi-stages (e.g., three-stage) at the ethylene compressor 51 driven by, for example, a gas turbine driver (not illustrated). The stages of compression may exist in a single unit or a plurality of separate units mechanically coupled to a single driver.

The cooled stream in the conduit 120 exiting the low-stage propane chiller 35 is routed to the high-stage ethylene chiller 53, where it is cooled via the indirect heat exchange 59 of the high-stage ethylene chiller 53. The remaining liquefied ethylene refrigerant exiting the high-stage ethylene chiller 53 in a conduit 220 may re-enter the ethylene economizer 56 and undergo further sub-cooling by an indirect heat exchange 61 in the ethylene economizer 56. The resulting sub-cooled refrigerant stream exits the ethylene economizer 56 through a conduit 222 and passes a pressure reduction system 62, such as an expansion valve, whereupon the pressure of the refrigerant stream is reduced to vaporize or flash a portion of the refrigerant stream. The resulting, cooled two-phase stream in a conduit 224 enters the low-stage ethylene chiller/condenser 55.

A portion of the cooled natural gas stream exiting the high-stage ethylene chiller 53 is routed through conduit a 122 to enter an indirect heat exchange 63 of the low-stage ethylene chiller/condenser 55. In the low-stage ethylene chiller/condenser 55, the cooled stream is at least partially condensed and, often, subcooled through indirect heat exchange with the ethylene refrigerant entering the low-stage ethylene chiller/condenser 55 through the conduit 224. The vaporized ethylene refrigerant exits the low-stage ethylene chiller/condenser 55 through a conduit 226, which then enters the ethylene economizer 56. In the ethylene economizer 56, vaporized ethylene refrigerant stream is warmed through an indirect heat exchange 64 prior to being fed into a low-stage inlet port of the ethylene compressor 51 through a conduit 230. As shown in FIG. 1, a stream of compressed ethylene refrigerant exits the ethylene compressor 51 through a conduit 236 and subsequently enters the ethylene cooler 52. At the ethylene cooler 52, the compressed ethylene stream is cooled through indirect heat exchange with an external fluid (e.g., water or air). The resulting cooled ethylene stream may be introduced through the conduit 202 into high-stage propane chiller 33B for additional cooling, as previously described.

The condensed and, often, sub-cooled liquid natural gas stream exiting the low-stage ethylene chiller/condenser 55 in a conduit 124 can also be referred to as a "pressurized LNG-bearing stream." This pressurized LNG-bearing stream exits the low-stage ethylene chiller/condenser 55 through the conduit 124 prior to entering a main methane economizer 73. In the main methane economizer 73, methane-rich stream in the conduit 124 may be further cooled in an indirect heat exchange 75 through indirect heat exchange with one or more methane refrigerant streams (e.g., 76, 77, 78). The cooled, pressurized LNG-bearing stream exits the main methane economizer 73 through a conduit 134 and is routed to the expansion section 80 of the methane refrigeration cycle 70. In the expansion section 80, the pressurized LNG-bearing stream first passes through a high-stage methane expansion valve or expander 81, whereupon the pressure of this stream is reduced to vaporize or flash a portion thereof. The resulting two-phase methane-rich stream in a conduit 136 enters into a high-stage methane flash drum 82. In the high-stage methane flash drum 82, the vapor and liquid portions of the reduced-pressure stream are separated. The vapor portion of the reduced-pressure stream (also called the high-stage flash gas) exits the high-stage methane flash drum 82 through a conduit 138 and enters into the main methane economizer 73. At the main methane economizer 73, at least a portion of the high-stage flash gas is heated through the indirect heat exchange means 76 of the main methane economizer 73. The resulting warmed vapor stream exits the main methane economizer 73 through the conduit 138 and is routed to a high-stage inlet port of the methane compressor 71, as shown in FIG. 1.

The liquid portion of the reduced-pressure stream exits the high-stage methane flash drum 82 through a conduit 142 and re-enters the main methane economizer 73. The main methane economizer 73 cools the liquid stream through indirect heat exchange 74 of the main methane economizer 73. The resulting cooled stream exits the main methane economizer 73 through a conduit 144 and is routed to a second expansion stage, illustrated in FIG. 1 as intermediate-stage expansion valve 83 and/or expander, as an example. The intermediate-stage expansion valve 83 further reduces the pressure of the cooled methane stream, which reduces a temperature of the stream by vaporizing or flashing a portion of the stream. The resulting two-phase methane-rich stream output in a conduit 146 enters an intermediate-stage methane flash drum 84. Liquid and vapor portions of the stream are separated in the intermediate-stage flash drum 84 and output through conduits 148 and 150, respectively. The vapor portion (also called the intermediate-stage flash gas) in the conduit 150 re-enters the methane economizer 73, wherein the vapor portion is heated through an indirect heat exchange 77 of the main methane economizer 73. The resulting warmed stream is routed through a conduit 154 to the intermediate-stage inlet port of methane compressor 71.

The liquid stream exiting the intermediate-stage methane flash drum 84 through the conduit 148 passes through a low-stage expansion valve 85 and/or expander, whereupon the pressure of the liquefied methane-rich stream is further reduced to vaporize or flash a portion of the stream. The resulting cooled two-phase stream is output in a conduit 156 and enters a low-stage methane flash drum 86, which separates the vapor and liquid phases. The liquid stream exiting the low-stage methane flash drum 86 through a conduit 158 comprises the liquefied natural gas (LNG) product at near atmospheric pressure. This LNG product may be routed downstream for subsequent storage, transportation, and/or use.

A vapor stream exiting the low-stage methane flash drum 86 (also called the low-stage methane flash gas) in a conduit 160 is routed to the methane economizer 73. The methane economizer 73 warms the low-stage methane flash gas through an indirect heat exchange 78 of the main methane economizer 73. The resulting stream exits the methane economizer 73 through a conduit 164. The stream is then routed to a low-stage inlet port of the methane compressor 71.

The methane compressor 71 comprises one or more compression stages. In one implementation, the methane compressor 71 comprises three compression stages in a single module. In another implementation, one or more of the compression modules are separate but mechanically coupled to a common driver. Generally, one or more intercoolers (not shown) are provided between subsequent compression stages.

As shown in FIG. 1, a compressed methane refrigerant stream exiting the methane compressor 71 is discharged into a conduit 166. The compressed methane refrigerant is routed to the methane cooler 72, and the stream is cooled through indirect heat exchange with an external fluid (e.g., air or water) in the methane cooler 72. The resulting cooled methane refrigerant stream exits the methane cooler 72 through a conduit 112 and is directed to and further cooled in the propane refrigeration cycle 30. Upon cooling in the propane refrigeration cycle 30 through a heat exchanger 37, the methane refrigerant stream is discharged into s conduit 130 and subsequently routed to the main methane economizer 73, and the stream is further cooled through indirect heat exchange 79. The resulting sub-cooled stream exits the main methane economizer 73 through a conduit 168 and then combined with the stream in the conduit 122 exiting the high-stage ethylene chiller 53 prior to entering the low-stage ethylene chiller/condenser 55, as previously discussed.

In some cases, solid deposition occurs early in the LNG process (i.e. the relative warmer section of the cryogenic process) when processing certain "lean" feed gases, which contain relatively low concentrations of mid-range components (C2-C5) but high concentrations of C6-C11 and C12+. Typically, C6-C11 freezing happens at the later section in the LNG process. However, with cryogenic conditions required for liquefying the natural gases, C12+ often forms solid deposition on the process equipment with even trace concentrations, which is problematic for plant operation and impairs LNG production. Stated, differently LNG plant feedstocks often contain heavy hydrocarbon components which tend to form solids (i.e. "freeze") at the cryogenic temperatures required for a natural gas liquefaction process. Without being sufficiently removed, the heavy components would freeze and deposit on the process equipment in the cold sections of the plant, which could eventually plug the equipment and result a plant shutdown. Thus, in some cases, the feed to the LNG facility 100 contains heavy hydrocarbon material which precipitates and collects in the high-stage ethylene chiller 53. The two-stage heavies removal of the presently disclosed technology solves the freezing issues caused by such "lean" feed gases by removing very heavy freezing components (C12+) prior to the feed gases entering the chilling section in the LNG process, such as the high-stage ethylene chiller 53, therefore preventing the equipment from detriment.

In one implementation, a Cascaded Two-stage Heavies Removal Unit (CTHRU) includes a Heavies Pre-Removal (HPR) section and a Heavies Deep-Removal (HDR) section. The HPR and HDR are two separate but integrated sections of the Cascaded Two-stage Heavies Removal Unit (CTHRU) of the LNG facility 100 to remove different heavy components in the feed gas. The HPR removes the very heavy components (C12+) from the feed gas at the warm section of the LNG process and prepare the feed gas for further removal of the heavies; the HDR removes the C6-C11 prior to the gas proceeding to the cold section and supply the internal solvent to promote C12+ removal in the HPR. Very Heavy components in the feed gas are eliminated by increasing the "richness" of the feed gas and by reducing its temperature in the Heavies Pre-removal (HPR) section. In one implementation, the two stages of heavies removal are realized through internal liquid circulation and pressure reduction, respectively.) The HPR section may include, without limitation, a turbo-expander, a compressor, two drums, two exchangers and a pump.

In one implementation, an internal liquid stream is established from the HDR section to fully mix with the feed gas to increase the "richness" of the feed gas and make condensation of heavy components easier, such that the very heavy component could be removed in the HPR section. The bottoms liquid condensed in the HDR section contains the desirable quality to work as an internal solvent, as it is free of very heavy components (C12+) and rich in C5-C9, which absorb all problematic components (C12+) in the warm section of the LNG facility 100.

The internal liquid is mixed with the feed gas upstream of the HPR section to prepare the desired gas composition for the HPR. The liquid is fully vaporized and dispersed in the feed gas through an injection device, therefore boosting the richness of the feed gas. The "richer" gas then flows through a pressure reduction device, such as a JT valve or gas Expander, by which the outlet gas temperature drops, thereby leading to a partial condensation of the feed gas. The freezing components (C12+) are dropped from the vapor phase and retained in the liquid phase, facilitating removal of the freezing and thus fouling components in separation equipment.

After removing freezing components (C12+) in the Heavies Pre-Removal (HPR) section, the feed gas is chilled without freezing in the high-stage ethylene chiller 53. The chilling can be achieved through expansion, such as JT or isentropic, with or without additional refrigeration supplied by an internal cold stream or an external refrigerant. With further reductions of pressure and temperature, the feed gas continues to condense and enters the HDR section which is the second stage of the Heavies Removal Unit to remove the heavy components (typical C6-C11) remained in the feed gas. Separation equipment in the HDR could be a separator or a mass transfer column with or without auxiliary equipment (i.e. reboiler, condenser, stripping gas, reflux etc.). The liquid separated in the HDR is recirculated to upstream of the HPR to assist C12+ removal. The liquids from the HPR and HDR sections contain some light components such as C1, C2, C3, C4s etc., which are typically distilled and recovered. C5+, on the other hand, leaves the process as condensate product.

Turning to FIG. 2, an example LNG production system 400 with two-stage heavies removal is shown. The LNG production system 400 may be deployed in the LNG facility 100, for example to curtail heavy hydrocarbon deposition in the high-stage ethylene chiller 53. In one implementation, the LNG production system 400 includes a heavies pre-removal section 412 disposed between a first feed chiller heat exchanger 402, such as a low-stage propane-ethylene feed chiller, and a second feed chiller heat exchanger 422, such as a high-stage ethylene chiller. Although the first feed chiller heat exchanger 402 and the second feed chiller heat exchanger 422 are described with respect to FIG. 2 as the low-stage propane-ethylene feed chiller 402 and the high-stage ethylene chiller 422, respectively, it will be appreciated that the presently disclosed technology may be applicable to other feed chiller heat exchangers as well.

In one implementation, bottoms liquid is recirculated from a heavies removal column 424 to the heavies pre-removal section 412 to modify a composition of feed gas from the low-stage propane-ethylene feed chiller 402. Within the heavies pre-removal section 412, fouling components with high freezing propensity at the high-stage ethylene chiller 422 (e.g., C12-C16) are removed. The heavies removal column 424 removes the remainder of the heavies, thereby providing an integrated heavies removal system, which removes the heavies in two stages.

Referring to FIG. 2, in one implementation, feed gas from the low-stage propane-ethylene feed chiller 402 flows to an expander suction scrubber 408, which is a vertical separator that protects a feed gas expander 414 from erosion. The feed gas is injected with the bottoms liquid from the heavies removal column 424 using an injection device before entering the expander suction scrubber 408. In one implementation, the bottoms liquid is pumped using one or more liquid injection pumps 406. The injected liquid is fully vaporized and dispersed in the feed gas by the injection device, therefore boosting the richness of the feed gas. The expander suction scrubber 408 removes any formed liquid from the feed gas and directs the formed liquid to a debutanizer 410.

In one implementation, the "richer" gas output from the expander suction scrubber 408 flows through the feed gas expander 414, where its pressure is reduced, for example, to approximately 730 psig (≈5033 kPa and 50 bar). Due to this isentropic expansion, the outlet gas temperature drops, thereby leading to a partial condensation of the gas. This two-phase stream is directed to an expander outlet separator 418. A bypass valve (e.g., a JT Valve) around the expander 414 may be provided so that the heavies pre-removal section 412 can be continuously operated, even when the expander 414 is tripped.

The liquid formed through expansion using the expander 414 contains the freezing components (e.g., C12-C16) and is removed in expander outlet separator 418. In one implementation, the expander outlet separator 418 is a vertical vessel with an internal head which divides the vessel into two sections. Liquids collected at the upper section of the expander outlet separator 418 are routed to an expander outlet separator heater 420 where light components are partially vaporized and sent back to the separator 418. Dry feed gas may be used as heating medium in the separator heater 420 on temperature control to maintain the temperature of the heater vapor. The liquid from the separator heater 420 is sent to the lower section of the expander outlet separator 418. From there, the liquid, joined by the liquid that may accumulate in the expander outlet separator 418, is routed to a debutanizer feed heater associated with the debutanizer 410. The vapor exiting from the separator 418 is compressed to approximate 830 psig (≈5723 kPa and 57 bar) by a feed gas re-Compressor 416. In one implementation, the re-compressor 416 is a centrifugal compressor driven by work extracted by the expander 414.

After removing freezing components (C12-C16) in the heavies pre-removal section unit 412, the compressed feed gas is now ready to be chilled in the high-stage ethylene chiller 422. The heavies removal column 424 provides a second stage heavies removal, removing the remaining heavy components contained in the feed gas. In one implementation, the bottoms of the heavies removal column 424 is split into two streams. A major portion of the bottoms liquid is pumped by the liquid injection pumps 406 and recirculated to upstream of the expander suction scrubber 408 for injection into the feed gas, as previously described. The remainder of the liquid from the heavies removal column 424, combined with the liquids from the expander suction scrubber 408 and the expander outlet separator 418, is sent to the debutanizer feed heater and fed to the debutanizer 410.

In one implementation, the feed to the debutanizer 410 has a greatly reduced flow rate, with compositional changes (i.e. lower C2, and C3, and higher C5s concentrations), due to the recirculation of the bottoms liquid from the heavies removal column 424. To accommodate the reduced flow rate and compositional changes, the debutanizer 410 is operated at about 276 psig (≈1903 kPa and 19 bar), with an overhead temperature ranging from 120-150° F. (≈49-66° C.) and a bottoms temperature of around 385° F. (≈197° C.). Lighter components are distilled into the overhead of the debutanizer 410, while the heavier C6+ components (along with some lighter components) are removed in the liquid bottoms. Thus, the debutanizer 410 can make condensate product without distillation by a stabilizer. The liquid leaving the bottom with a RVP of 8.6 psia (≈59.3 kPa 0.6 bar) is cooled in a condensate cooler and then sent to a condensate storage. Overhead vapor from the debutanizer 410 is partially condensed in a debutanizer overhead cooler, and the liquid and vapor are separated in a debutanizer reflux drum. The liquid is pumped by the debutanizer reflux pumps and routed to the debutanizer 410 as reflux. Vapor is sent from the debutanizer reflux drum to the methane refrigeration system of each train under pressure control.

In one implementation, the expander 414 removes C12-C16 components contained in the feed gas by lowering the feed gas temperature through expansion, thus promoting condensation of heavy components. The expander outlet pressure dictates this expansion and condensation. For example, the expander 414 may have a discharge pressure of 730 psig 5033 kPa and 50 bar).

Re-recompression of the feed gas using the re-compressor 416 provides sufficient feed gas pressure to the downstream chilling, heavies removal, and LNG liquefaction sections. The re-compressor 416 may be driven by the work generated by the expander 414 to compress the feed gas to approximate 830 psig (≈5723 kPa and 57 bar) prior to entering the high-stage ethylene chiller 422. Generally, the feed gas may be expanded by reducing a pressure of the feed gas below a return pressure dictated by downstream liquefaction equipment, which may be approximately 50 psi (≈345 kPa and 3 bar), 75 psi (≈517 kPa and 5 bar), 100 psi (≈689 kPa and 7 bar), 125 psi (≈862 kPa and 9 bar), 150 psi (≈1034 kPa and 10 bar), 175 psi (≈1207 kPa and 12 bar), 200 psi (≈1379 kPa and 14 bar), 225 psi (≈1551 kPa and 16 bar), 250 psi (≈1724 kPa and 17 bar), 275 psi (≈1896 kPa and 19 bar), 300 psi (≈2068 kPa and 20 bar), 350 psi (≈2413 kPa and 24 bar), 400 psi (≈2758 kPa and 28 bar), 450 psi (≈3103 kPa and 31 bar), 500 psi (≈3447 kPa and 45 bar), 550 psi (≈3792 kPa and 38 bar), 600 psi (≈4137 kPa and 41 bar), 650 psi (≈4482 kPa and 45 bar), and/or the like. Similarly, the vapor may be compressed to the return pressure dictated by the downstream liquefaction equipment, which may be approximately 650 psig (≈4482 kPa and 45 bar), 700 psig (≈4826 kPa and 48 bar), 750 psig 5171 kPa and 52 bar), 800 psig (≈5512 kPa and 55 bar), 850 psig (≈5861 kPa and 59 bar), 900 psig (≈6205 kPa and 62 bar), 950 psig (≈6550 kPa and 66 bar), 1000 psig (≈6895 kPa and 69 bar), 1050 psig (≈7240 kPa and 72 bar), 1100 psig (≈7584 kPa and 75 bar), 1150 psig (≈7929 kPa and 79 bar), and/or the like.

In one implementation, the expander 414 is a turbo-expander with: enough pressure and temperature reductions through isentropic expansion to condense freezing components (C12-C16); adequate pressure delivered to the other equipment of the LNG production system 400, including the pressure for removing heavies in the heavies removal column 424; and a power balance between the expander 414 and the re-compressor 416. As such, the heavies pre-removal section 412 delivers feed gas to the high-stage ethylene chiller 422 at a comparably lower pressure than other methods, but the feed gas is enriched with the injected recycle liquid and has a comparatively colder temperature than current methods. Thus, the feed gas can meet conditions (i.e. temperature, liquid fraction) for the heavies removal column 424 to remove the remainder of the heavies, as described herein.

Full flow JT valve and re-compressor bypass may be provided for the expander 414 in some implementations. When the expander trips, the JT valve and the re-compressor bypass valve both open to keep the feed gas flowing, such that operation of the heavies pre-removal section 412 can continue until the expander 414 restarts. Where there is loss of the isentropic expansion by expander 414, the heavies removal efficiency may be reduced. Thus, during JT operation, the operation pressure of the expander outlet separator 418 may be increased from a normal operating pressure to maintain LNG production. The JT valve and the re-compressor bypass valve can also provide transition operation until manual heavies pre-removal section 412 bypass valves can be opened to completely bypass the heavies pre-removal section 412.

As described herein, "richness" of the feed gas is increased, thereby facilitating condensation of heavy components, by injecting an internal liquid stream to be fully mixed with the feed gas. In one implementation, the internal liquid stream comprises bottoms liquid from the heavies removal column 424. The bottoms liquid from the heavies removal column 424 is heavies (C12-C16) free and rich in C5-C9, which can remove all fouling components for the high-stage ethylene chiller 422, as well as effectively remove C12-C16 for all feed gas compositions. Full vaporization and uniform distribution of the liquid into the feed gas is ensures that the heavy components contained in the vapor phase are condensed as the feed gas temperature drops through the expander 414.

In one implementation, the heavies pre-removal section 412 includes a liquid recirculation system including one or more pumps, control valves, and an injection device. The pumps, such as the pumps 406, elevate the pressure of the liquid from the bottom of the heavies removal column 424. The control valve regulates liquid flow to the injection device that disperses the liquid into the feed exiting the low-stage propane-ethylene feed chiller 402. As described herein, the liquid is injected at the main feed line to the expander suction scrubber 408, rather than the expander outlet separator 418. Since the liquid is combined with the feed upstream of the expander suction scrubber 408, it is thoroughly combined with the gas as the mixture flows through the various pieces of equipment before entering the expander outlet separator 418.

The liquid is recirculated using the liquid recirculation system at a recirculation rate that: sufficiently removes C12-16 in the heavies pre-removal section 412; optimizes heavies removal performance (C6+) in the heavies removal column 424; accommodates a capacity of the heavies removal column 424 (e.g., liquid handling capacity of bottom packing, reboiler duty, etc.); accommodates operation limitations of the debutanizer 410 (e.g., pressure, overhead reflux system, etc.); eliminates or reduces carry-over of heavier components from the heavies removal column 424 overhead.

As described herein, the heavies pre-removal section 412 includes a plurality of drums, including the expander suction scrubber 408 and the expander outlet separator 418. In one implementation, the expander suction scrubber 408 is located at the upstream of the expander, such that any liquid, for example formed from upstream chilling or uncompleted vaporization of recycle liquid, is removed before entering the expander 414. Thus, the expander suction scrubber 408 protects the expander 414 from erosion due to excessive liquid in the feed gas. In one implementation, the expander outlet separator 418 is at the discharge of the expander 414 where the liquid formed through the expansion is collected and separated. The very heavy components which contribute to the fouling of the high-stage ethylene chiller 422 are retained in the liquid phase at the process conditions, thus, the vapor leaving the expander outlet separator 418 is sufficiently "clean" (i.e., free of fouling components) to enter the high-stage ethylene chiller 422 for further chilling.

The expander outlet separator 418 also protects the re-compressor from excessive liquid carryover.

As can be understood, by directing the liquids from the two drums 408 and 418 to the upstream of the debutanizer 410, the very heavy components are segregated from the remaining heavies removal process at the heavies removal column 424. Each of the drums 408 and 418 may include installations of high efficiency inlet devices and demisters.

In one implementation, the expander suction scrubber 408 is normally a "dry" vessel. Liquid may form in the upstream chilling section when processing rich gas compositions. The liquid can be slowly introduced to the debutanizer 410 if the liquid level builds up in the expander suction scrubber 408. A scrubber heater may be provided for intermittent needs to avoid potential freezing of the accumulated liquid in expander suction scrubber 408.

In one implementation, the expander outlet separator 418 includes an internal head which divides the vessel into two sections. Since the liquid collected from the upper compartment contains light components (e.g., methane, ethane), the liquid letdown valve may be subject to potential freezing due to pressure reduction. Thus, the light components are reduced with the separator heater 420, as opposed to letting down liquids immediately. Dry feed gas may be brought to the separator heater 420 on temperature control to maintain temperature of the reboiler vapor. The lower section of the expander outlet separator 418 holds up the liquid returned from separator heater 420 for control stability. The vapor from separator heater 420 may be prevented from being too warm to ensure the heavies are retained in the liquid phase. Stated differently, overheating the liquid will vaporize excessive heavies and may send some fouling components back to the feed gas to high-stage ethylene chiller 422.

Figure 3:
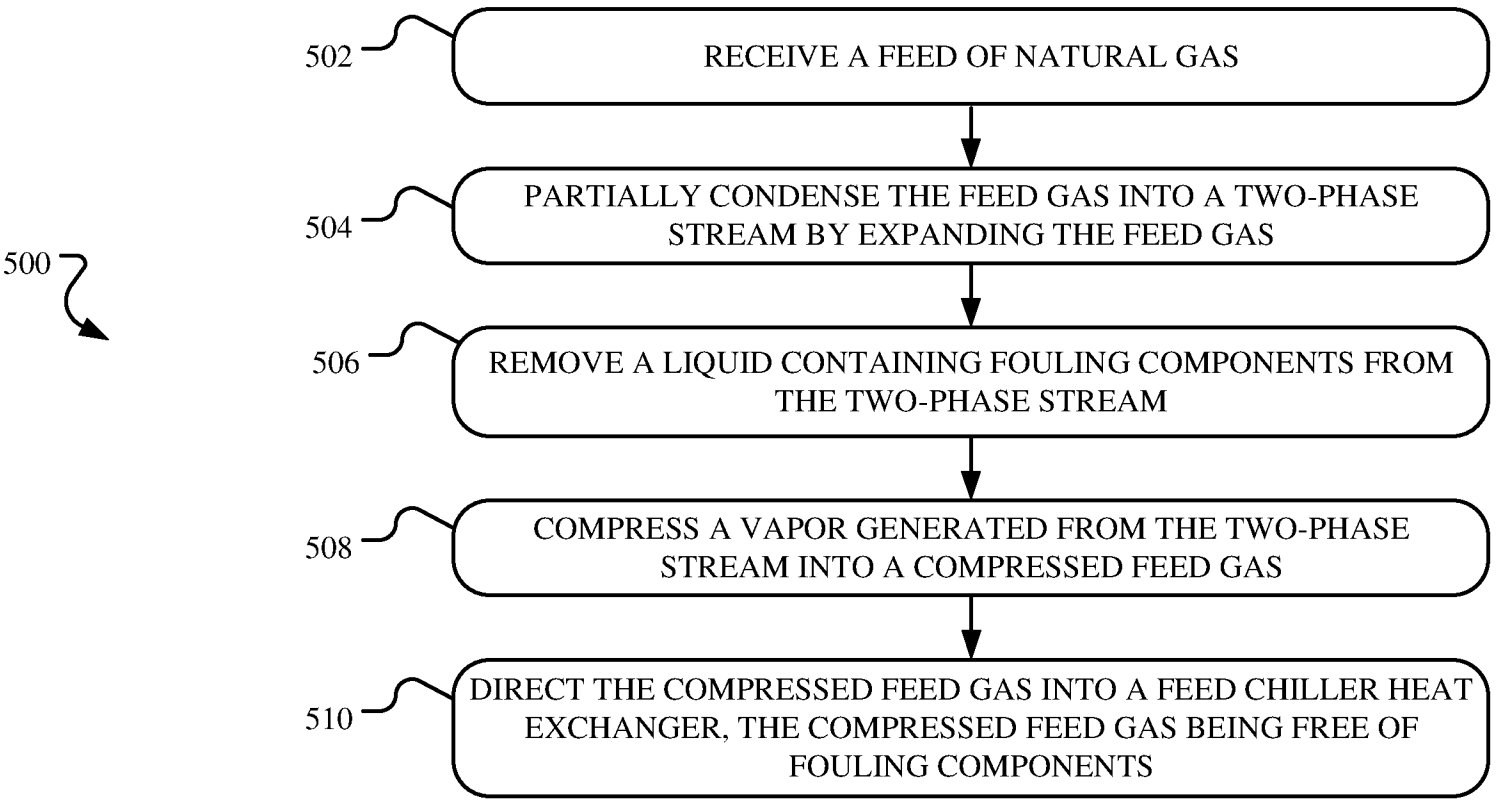
FIG. 3 illustrates example operations for reducing fouling in LNG production.

Referring to FIG. 3, example operations 500 for reducing fouling in LNG production are illustrated. In one implementation, an operation 502 receives a feed of natural gas, and an operation 504 partially condenses the feed gas into a two-phase stream by expanding the feed gas. An operation 506 removes a liquid containing fouling components from the two-phase stream. An operation 508 compresses a vapor generated from the two-phase stream into a compressed feed gas, and an operation 510 directs the compressed feed gas into a feed chiller heat exchanger. The compressed feed gas is free of the fouling components.

Figure 4:
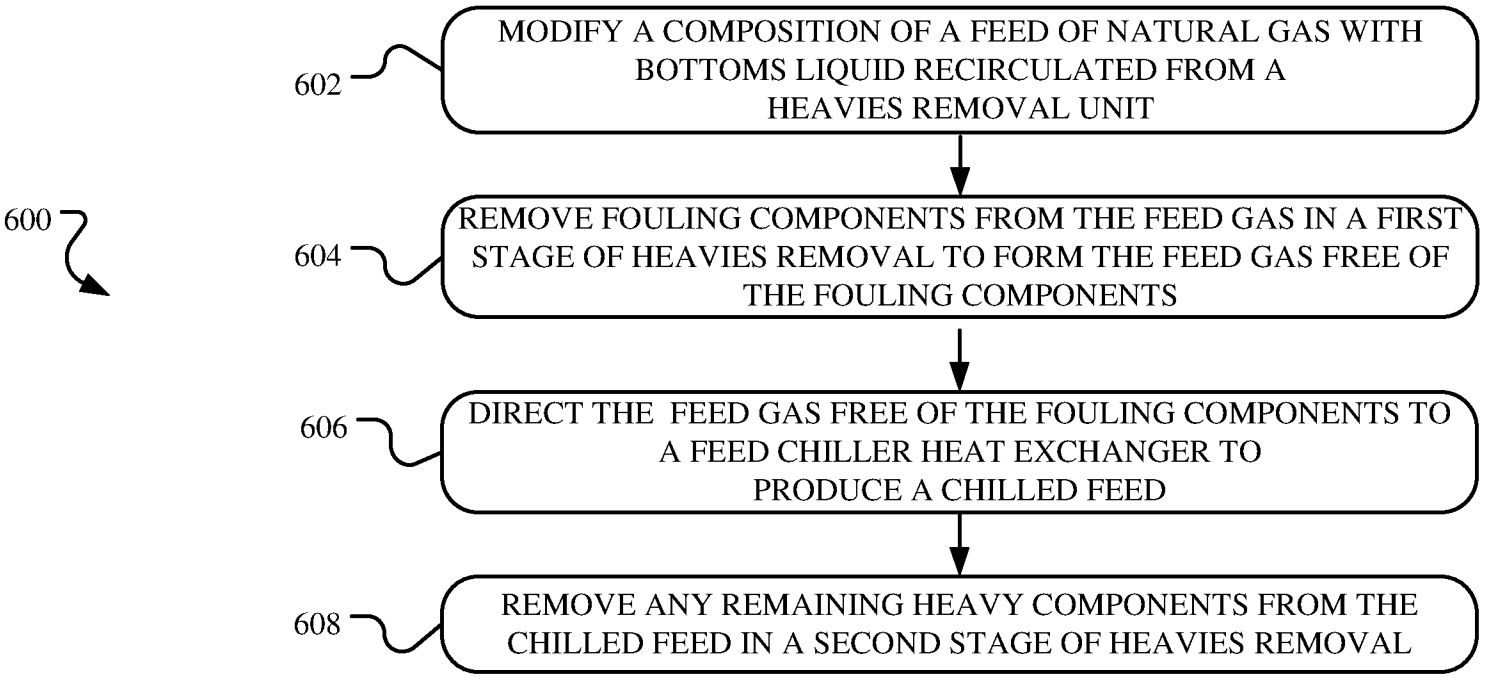
FIG. 4 illustrates example operations for two-stage heavies removal.

Turning next to FIG. 4, example operations 600 for two-stage heavies removal are illustrated. In one implementation, an operation 602 modifies a composition of a feed of natural gas with bottoms liquid recirculated from a heavies removal unit. An operation 604 removes fouling components are removed from the feed gas in a first stage of heavies removal. The fouling components are removed by separating an isentropically expanded stream into a liquid containing the fouling components and a vapor. The vapor is compressed to form the feed gas free of the fouling components. An operation 606 directs the feed gas free of the fouling components into a feed chiller heat exchanger to produce a chilled feed. An operation 608 removes any remaining heavy components from the chilled feed in a second stage of heavies removal.

It will be appreciated that the example LNG production system 400 and example operations 500-600 are exemplary only and other systems or modifications to these systems may be used to eliminate or otherwise reduce fouling in the high-stage ethylene chiller 53 in accordance with the presently disclosed technology.

It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A method for reducing fouling in a liquefied natural gas (LNG) facility, the method comprising:

receiving a feed gas;

partially condensing the feed gas into a two-phase stream by expanding the feed gas, wherein the two-phase stream includes a liquid that includes fouling components, the fouling components including C12-C16 hydrocarbons;

separating the two-phase stream into a liquid stream and a gas stream in an expander outlet separator, the liquid stream including light components;

partially vaporizing the light components in a expander outlet separator heater from the liquid stream to form a vapor stream, the vapor stream directed from an outlet of the expander outlet separator heater into an inlet of an upper section of the expander outlet separator for joining with the gas stream for output as a vapor, any remaining liquid from the liquid stream directed from the expander outlet separator heater into a lower section of the expander outlet separator for joining a liquid accumulation for removal as the liquid containing the fouling components;

compressing the vapor output from the expander outlet separator into a compressed feed gas; and directing the compressed feed gas into a feed chiller heat exchanger, the compressed feed gas free of the fouling components.

2. The method of claim 1, wherein the feed gas is injected with bottoms liquid from a heavies removal column.

3. The method of claim 2, wherein the bottoms liquid is vaporized and dispersed in the feed gas.

4. The method of claim 1, further comprising:

removing heavy components from the compressed feed gas using a heavies removal column following chilling with the feed chiller heat exchanger.

5. The method of claim 1, wherein the feed gas is isentropically expanded such that the two-phase stream is an isentropically expanded stream.

6. The method of claim 5, wherein the liquid that includes the fouling components is removed from the feed gas in a first stage of removal.

7. The method of claim 6, wherein the isentropically expanded stream is formed by a feed gas expander of a heavies pre-removal section isentropically expanding the feed gas.

8. The method of claim 7, wherein compressing the vapor from the two-phase stream into the compressed feed gas is performed by a feed gas re-compressor of the heavies pre-removal section.

9. The method of claim 5, further comprising:

chilling the compressed feed gas using the feed chiller heat exchanger.

10. The method of claim 9, further comprising:

removing heavy components from the chilled feed in a second stage of removal.

11. The method of claim 1, wherein expanding the feed gas includes partially condensing the feed gas through isentropic expansion.

12. A system for reducing fouling in a liquefied natural gas (LNG) facility, the system comprising:

a feed gas expander configured to receive a feed gas, the feed gas expander configured to partially condense the feed gas into a two-phase stream by expanding the feed gas, wherein the two-phase stream includes a liquid that includes fouling components, the fouling components including C12-C16 hydrocarbons;

an expander outlet separator configured to separate the two-phase stream into a liquid stream and a gas stream, the liquid stream including light components;

an expander outlet separator heater configured to partially vaporize light components from the liquid stream to form a vapor stream, the vapor stream directed from an outlet of the expander outlet separator heater into an inlet of an upper section of the expander outlet separator for joining with the gas stream for output as a vapor, any remaining liquid from the liquid stream configured to be directed from the expander outlet separator heater into a lower section of the expander outlet separator for joining a liquid accumulation for removal as the liquid containing the fouling components; and a feed gas re-compressor configured to compress the vapor output from the expander outlet separator into a compressed feed gas, the compressed feed gas configured to be directed into a feed chiller heat exchanger, the compressed feed gas free of the fouling components.

13. The system of claim 12, further comprising:

an expander suction scrubber, the feed gas configured to flow through the expander suction scrubber prior to entering the feed gas expander.

14. The system of claim 12, wherein the feed gas is configured to be injected with bottoms liquid from a heavies removal column.

* * * * *